US007238161B2

(12) United States Patent
Komkin et al.

(10) Patent No.: US 7,238,161 B2
(45) Date of Patent: Jul. 3, 2007

(54) APPARATUS AND METHOD FOR PASSIVE AND ACTIVE THERAPEUTIC EXERCISE

(76) Inventors: Andrei V. Komkin, Georgieva Str. 15-70, 656061 Barnaul (RU); Alexander S. Pervov, 14960 SW. Ruby St., Beaverton, OR (US) 97007

( * ) Notice: Subject to any disclaimer, the term of this patent is extended or adjusted under 35 U.S.C. 154(b) by 227 days.

(21) Appl. No.: 10/666,026

(22) Filed: Sep. 17, 2003

(65) Prior Publication Data

US 2005/0033205 A1 Feb. 10, 2005

(51) Int. Cl.
*A61H 7/00* (2006.01)
*A61H 15/02* (2006.01)

(52) U.S. Cl. ..... 601/15; 601/131; 601/135; 601/40; 482/49

(58) Field of Classification Search ..... 601/131, 601/137, 112, 113, 15, 40, 17, 135, 139; 482/49; 220/229
See application file for complete search history.

(56) References Cited

U.S. PATENT DOCUMENTS

| | | | | |
|---|---|---|---|---|
| 564,258 | A * | 7/1896 | Rossbach | 601/20 |
| 744,718 | A * | 11/1903 | Cassidy | 601/131 |
| 1,947,042 | A * | 2/1934 | Glennan | 401/174 |
| 2,466,470 | A | 4/1949 | Norris | |
| 3,411,498 | A * | 11/1968 | Reiter | 601/136 |
| 3,760,800 | A * | 9/1973 | Staffin et al. | 601/17 |
| 4,191,178 | A * | 3/1980 | Wisnieski | 601/131 |
| 4,541,418 | A | 9/1985 | Kirby | |
| 4,846,159 | A * | 7/1989 | Anzai et al. | 601/128 |
| 5,389,063 | A * | 2/1995 | Wu | 601/135 |
| 5,413,551 | A * | 5/1995 | Wu | 601/46 |
| 5,693,004 | A * | 12/1997 | Carlson et al. | 601/23 |
| 6,299,585 | B1 * | 10/2001 | Yoo | 601/118 |
| 6,432,071 | B1 * | 8/2002 | Hsieh | 601/72 |
| 2004/0006294 | A1 * | 1/2004 | Zemont | 601/135 |
| 2005/0263523 | A1 * | 12/2005 | Moss | 220/229 |

FOREIGN PATENT DOCUMENTS

| | | | |
|---|---|---|---|
| DE | 3232431 | * | 3/1984 |
| JP | 408066454 A | * | 6/1996 |

OTHER PUBLICATIONS

Dedyukhina, G.V., Yanshina, T.A. and Mogutchaya, I.D., "Logopedic Massage and Therapeutic Physical Training for 3-5 Year Old Children Suffering from Infantile Cerebral Paralytis," Moscow "Gnom-Press" 1999.
"Rotating Golden Acupuncture Ball," Sungjin International Corp. Export Online Catalogue.

* cited by examiner

*Primary Examiner*—Danton DeMille
(74) *Attorney, Agent, or Firm*—Smith-Hill and Bedell

(57) ABSTRACT

A therapy apparatus includes a container having an interior volume and having an opening providing access to the interior volume and massaging elements freely located in the interior volume of the container. Each massaging element has a generally spherical exterior and has multiple protrusions projecting from its generally spherical exterior. A patient's hand may be inserted into the container through the opening and be moved among the massaging elements to be stimulated by massaging elements contacting the fingers and both the front and the back of the hand.

3 Claims, 4 Drawing Sheets

APPARATUS AND METHOD FOR PASSIVE AND ACTIVE THERAPEUTIC EXERCISE

BACKGROUND OF THE INVENTION

This invention relates to an apparatus and method for passive and active hand and finger exercise, particularly for development of the functions of hands and fingers and of sensory faculties, and for stimulation of neuropsychic and speech development in children suffering from infantile cerebral paralysis.

An apparatus for passive and active hand and finger exercise, comprising a container and massaging elements in the container, is known. See, for example, USSR Author's Certificate No. 1537250 published Jan. 23, 1990. In this apparatus the massaging elements are particles made of electrifying materials, such as copper, zinc, ebonite, etc. When using this apparatus during physical exercise, the particles contact the hand and carry out physical and electrical stimulation of biologically active points.

Another apparatus for passive and active exercise of the hands and fingers is disclosed in G. V. Dedyukhina, L. D. Mogutchaya, T. A. Yanshina, "Logopedic massage and therapeutic physical training for 3-5 year old children, suffering from infantile cerebral paralysis," M., "Gnom-Press," 1999, p. 17. This apparatus comprises a container and working elements freely placed in the interior space of the container. The working elements are peas or kidney beans. A patient exercises by immersing the hands in the mass of working elements or rolling the working elements between the palms of the hands. In this manner the muscles of the hand are massaged. Finger exercises, such as selecting and removing individual working elements and distributing the working elements according to size, help activate motor functions of the hands, manipulation skills, and small motor functions. Massage and exercise with this apparatus are not satisfactory because they do not influence the biologically active points to a significant degree. The working elements, being practically uniform in size, shape and color, do not affect the psychoemotional status of the child and do not favor teaching through play. Accordingly the apparatus has only a small influence on medical factors. Further, since the working elements are small, use of the apparatus with children of 6-7 years or younger is not advisable due to the danger of swallowing or penetration into a respiratory passage or the ear.

SUMMARY OF THE INVENTION

In accordance with a first aspect of the invention there is provided a therapy apparatus comprising a container having an interior volume and having an opening providing access to said interior volume, and a plurality of massaging elements freely located in the interior volume of the container, wherein each massaging element has a generally spherical exterior and has a plurality of protrusions projecting from said generally spherical exterior, whereby a patient who inserts his hand into the container through the opening and moves his fingers among the plurality of massaging elements is stimulated by massaging elements contacting his fingers both at the front and at the back of the hand.

In accordance with a second aspect of the invention there is provided a method of administering therapy comprising providing a container having an interior volume and having an opening providing access to said interior volume, there being a plurality of massaging elements freely located in the interior volume of the container, wherein each massaging element has a generally spherical exterior and has a plurality of protrusions projecting from said generally spherical exterior, and instructing a patient to insert his hand into the container through the opening and move his fingers among the plurality of massaging elements, whereby the patient's fingers are stimulated by massaging elements contacting the fingers both at the front and at the back of the hand.

In accordance with a third aspect of the invention there is provided a massaging element having a generally spherical exterior and a plurality of substantially conical protrusions projecting from said generally spherical exterior, wherein the locations of the protrusions are selected by a method that comprises inscribing a spherical surface with a polyhedron composed of a plurality of regular polygons each having a center and multiple vertices, each vertex being common to exactly three polygons, and mapping the centers and the vertices of the polygons from the polyhedron onto the generally spherical exterior of the massaging element.

The present invention may be used to stimulate or develop many kinds of grasping or gripping actions, such as holding a massaging element in the palm of the hand, wrapping a finger around the massaging element, and holding the massaging element by the tips of the fingers.

The present invention may be used to provide an apparatus and method for passive and active hand and finger exercise, permitting point massage of the hand, particularly the hand of a child, and drawing the psychoemotional sphere of a patient into a medical or rehabilitational process, enriching or intensifying the therapeutic effect of the massaging elements and heightening the therapeutic effect and widening the field of use of the apparatus.

The essence of the invention is stimulation of passive movements in a patient with infantile cerebral palsy (patient with significant disorders of active voluntary movements) without help of a therapist.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
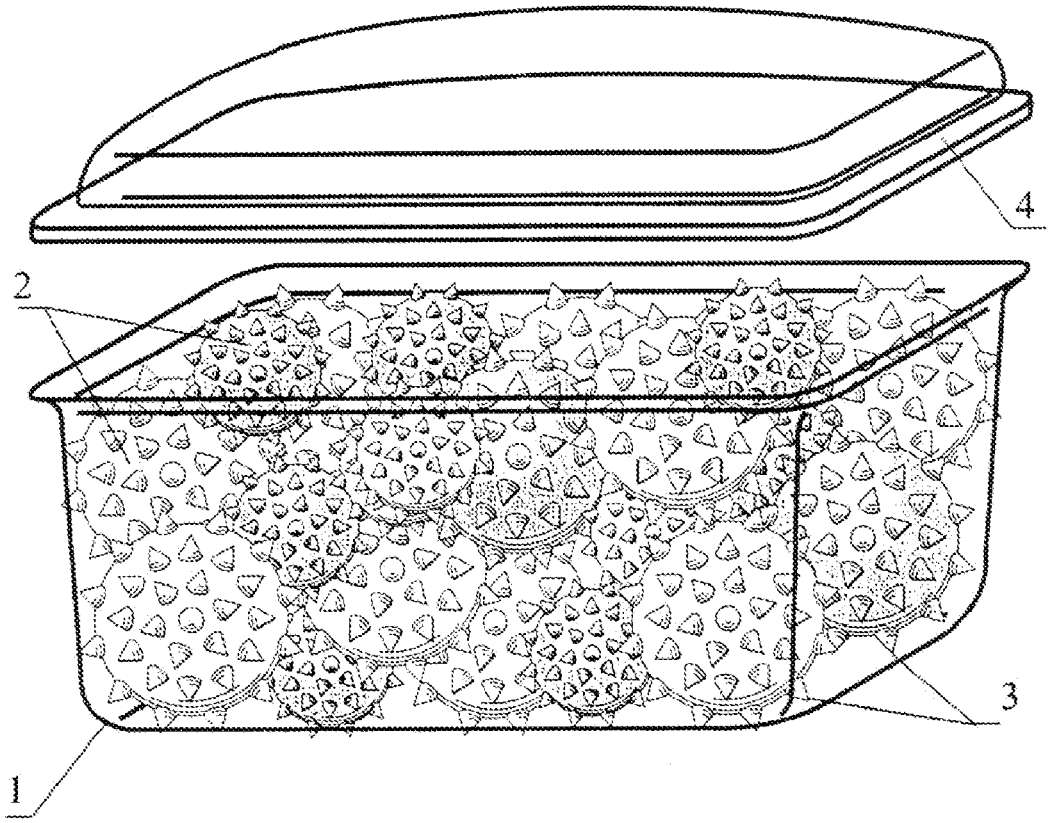
FIG. 1 is a perspective view of apparatus embodying the present invention.
Figure 2:
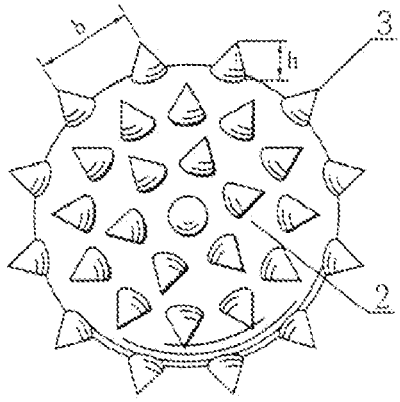
FIG. 2 is an elevational view of a massaging element.

FIG. 1 illustrates a container 1 having generally vertical walls and a rectangular, horizontal base. The container is made of a tough, transparent, chemically resistant, waterproof material such as polypropylene and has a lid or cover 15 of the same or a similar material. In the event that the mouth of the container is circular, the cover may be threaded to allow the cover to seal the container.

Inside the container are multiple massaging elements 2. The massaging elements are freely located in the container, so that they can be moved around in the container by finger pressure. The bottom of the container may have recesses for locating the massaging elements. Each massaging element has a generally spherical exterior surface. Conical massaging protrusions or lugs 3 project from the spherical exterior surface.

The massaging elements may be solid and made of material having a Shore hardness number from 5-95, preferably from 40-75. Suitable materials include synthetic polymer materials, such as polystyrene, and wood. The massaging elements may be made of an electrifying material, i.e. a material on which an electrostatic charge can be induced, such as ebonite. The massaging protrusions must be sufficiently hard to provide the desired stimulation.

Typically, a doctor treating a child having a neuropsychic disorder will prescribe a course of treatment, which would be supervised by a therapist, in which the child will be instructed to carry out exercises with a first set of massaging elements and then carry out exercises with a second, different set of massaging elements. In this manner, the set of massaging element is changeable during the treatment, rather than being fixed.

Figure 3:
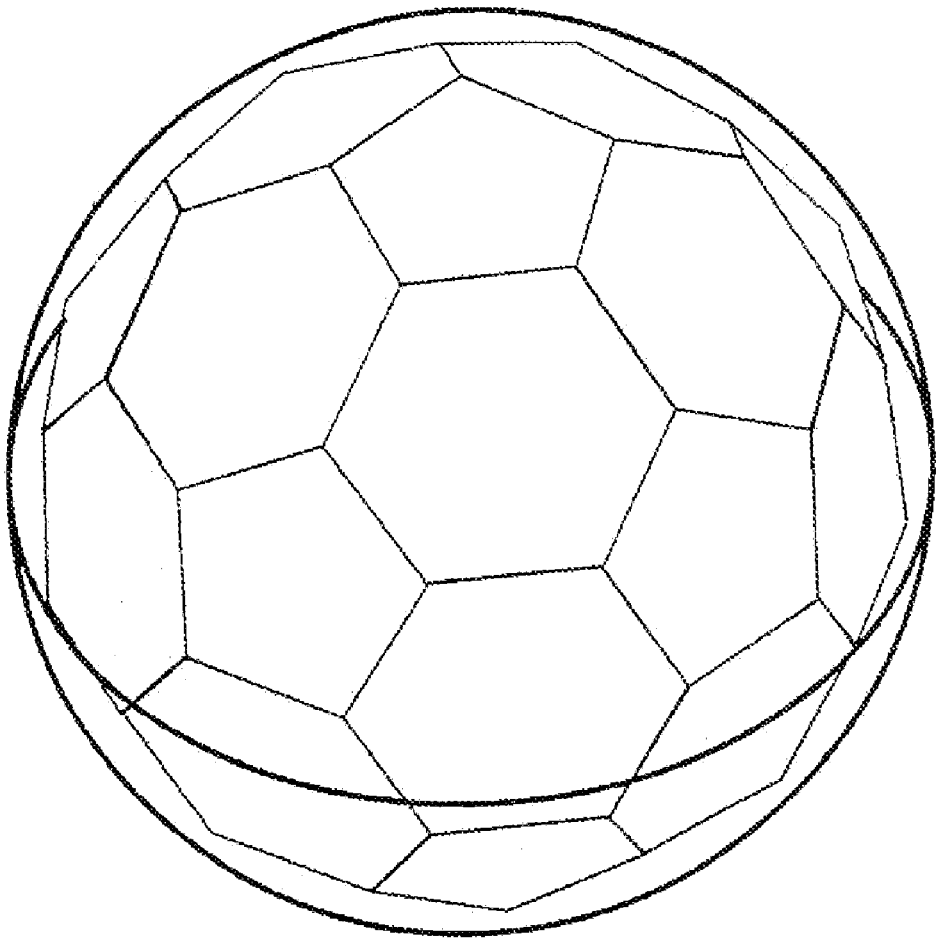
FIG. 3 illustrates a sphere inscribed with a polyhedron.
Figure 4:
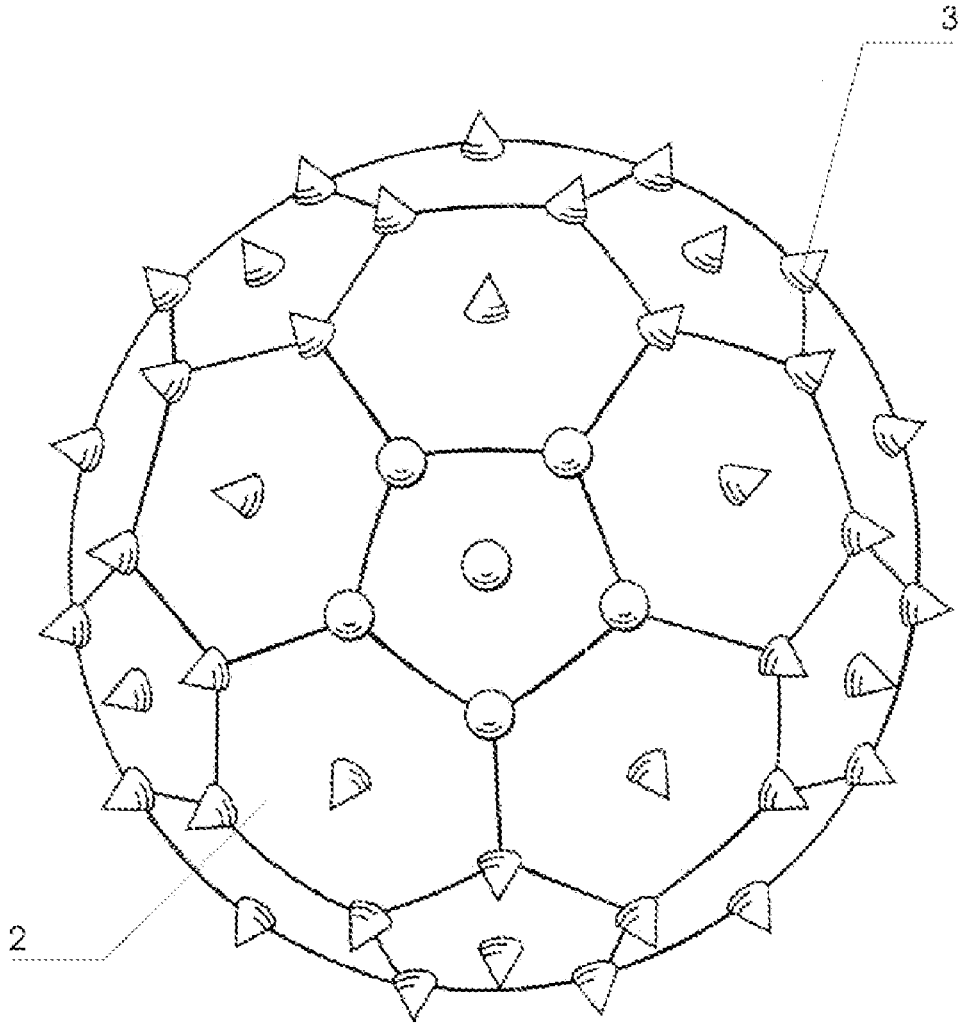
FIG. 4 illustrates a massaging element embodying the present invention.
Figure 5:
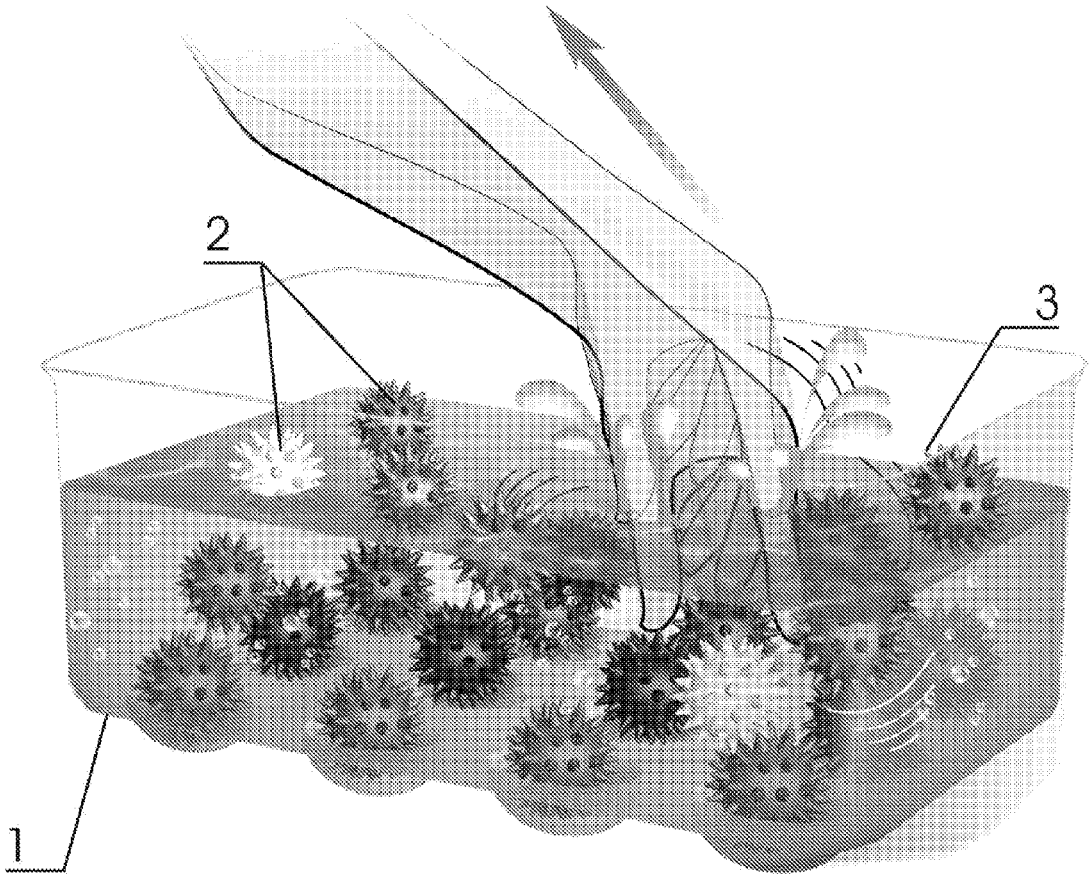
FIG. 5 illustrates operation of the apparatus and method for massaging a hand.

Referring to FIGS. 3 and 4, it is desirable that the locations of the massaging protrusions on a spherical massaging element should be selected by a procedure that involves first inscribing a sphere with a polyhedron composed of regular polygons, such as hexagons and pentagons as shown in FIGS. 3 and 4, and then selecting as the locations of the massaging protrusions the vertices of the polygons and the points on the surface of the sphere that are radially outward of the centers of the polygons. By use of this procedure, it is ensured that the protrusion at the center of a polygon is equidistant from the protrusions at the vertices of the polygon.

Desirably, the container 1 has a narrow mouth so that a child who has one of the massaging elements grasped in his hand cannot withdraw his hand from the container until he has released the massaging element. Liquid may be placed in the container with the massaging elements for hydrotherapy or balneological therapy. It may be desirable to provide the container with a threaded lid or cover for sealing the container. In the event that the mouth of the container is wider, the patient may be able to insert both hands in the container for simultaneous exercise of the fingers of both hands, which may be advantageous for some treatments.

It will be appreciated that the invention is not restricted to the particular embodiment that has been described, and that variations may be made therein without departing from the scope of the invention as defined in the appended claims and equivalents thereof. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated.

The invention claimed is:

1. A method of treating a patient comprising:

providing a container having an interior cavity and having an inlet opening providing access to said interior cavity, whereby the patient's extremity may be inserted into the container and be moved within the container, providing a plurality of massaging elements wherein each massaging element has a generally spherical exterior and has a plurality of projections extending from said generally spherical exterior, placing a sufficient number of massaging elements in the cavity that the patient's extremity will contact projections of several massaging elements during movement within the container, the massaging elements being freely disposed in the container, and placing the patient's extremity in the container through the inlet opening and driving massaging elements into motion, whereby the extremity is stimulated by the protrusions of multiple massaging elements contacting the extremity, and wherein there is a liquid medium in the container and the method comprises at least partially immersing the extremity in the liquid medium.

2. A massaging element comprising a spherical body and a plurality of projections disposed on an external surface thereof, the projections and the spherical body comprising an integral piece of solid material and the projections being disposed at projection points of apexes and centers of pentagons and hexagons of a polyhedron inscribed onto the body, on the spherical surface of the massaging element.

3. A therapy apparatus comprising:

a container having an interior cavity and having an inlet opening providing access to said interior cavity, whereby a patient's extremity may be inserted into the container and be moved within the container, a plurality of massaging elements disposed in the container, wherein each massaging element has a generally spherical exterior and has a plurality of pointed projections extending from said generally spherical exterior, there being a sufficient number of massaging elements in the cavity that a patient's extremity will contact projections of several massaging elements during movement within the container, and a liquid medium in the container.

* * * * *